US005429679A

United States Patent [19]

Young, Jr.

[11] Patent Number: 5,429,679

[45] Date of Patent: Jul. 4, 1995

[54] METHOD FOR OPERATING A LOW ENERGY DOMESTIC DISHWASHER

[76] Inventor: Raymond A. Young, Jr., 1907 Essex St., Kinston, N.C. 28501

[21] Appl. No.: 125,104

[22] Filed: Sep. 22, 1993

[51] Int. Cl.[6] ..... B08B 3/04

[52] U.S. Cl. ..... 134/25.2; 134/25.3; 134/18; 134/26; 134/10

[58] Field of Search ..... 134/25.2, 18, 10, 104.1, 134/104.2, 104.4

[56] References Cited

U.S. PATENT DOCUMENTS

| | | | |
|---|---|---|---|
| 3,020,917 | 11/1958 | Lyman | 134/58 |
| 4,289,543 | 9/1981 | Vallor | 134/25.2 |
| 4,346,723 | 8/1982 | Geiger | 134/104.4 |
| 4,347,861 | 9/1982 | Clearman | 134/104.4 |
| 4,392,891 | 7/1983 | Meyers | 134/25.2 |
| 4,559,959 | 12/1985 | Meyers | 134/56 D |
| 4,673,441 | 6/1987 | Mayers | 134/18 |
| 4,810,306 | 3/1989 | Noren | 134/25.2 |
| 4,872,466 | 10/1989 | Noren | 134/57 D |
| 5,165,433 | 11/1992 | Meyers | 134/104.4 |
| 5,223,042 | 6/1993 | Milocco | 134/25.2 |
| 5,320,120 | 6/1994 | Hoffman et al. | 134/104.1 |

*Primary Examiner*—Scott Kastler
*Assistant Examiner*—Saeed Chaudhry

[57] ABSTRACT

An improved control program for a dishwashing machine which reduces the energy consumption of the dishwashing machine. At the end of a first wash cycle, a portion of the wash liquid, which is at an elevated temperature, is expelled from the tub by operation of a pump. The portion of heated liquid expelled has entrained therein soil filtered from the wash liquid during the wash cycle. An amount of fresh wash liquid, generally equal to the amount expelled, is added to the dishwasher prior to a second wash cycle. The wash liquid is heated prior to the second wash cycle to return the wash liquid to the elevated temperature. The present invention reduces the liquid consumption of the dishwasher, and the amount of electricity used to heat the liquid as compared to current dishwashers which completely drain following each wash cycle.

10 Claims, 4 Drawing Sheets

METHOD FOR OPERATING A LOW ENERGY DOMESTIC DISHWASHER

BACKGROUND OF THE INVENTION

1. Field of the Invention

The present invention pertains to dishwashing machine control programs and, more particularly, to dishwashing machine control programs which reduce water and energy consumption.

2. Description of the Related Art

As concerns regarding dishwashing machine energy consumption have developed, several methods have been proposed to limit or reduce the amount of energy and water necessary to perform the series of cycles required for each load of dishes.

U.S. Pat. Nos. 4,559,959 and 4,673,441 disclose one method of reducing water and energy usage wherein a pre-wash is performed. A series of sensors are provided which determine when an amount of soil has been filtered from the wash water, and the wash water is drained from the tub. By having pre-wash cycles in accordance with the sensed amount of soil collected, only the necessary number of pre-wash cycles are performed, and water and energy are conserved. There is no discussion of the desirability of partially draining the dishwasher tub, or of retaining a portion of the water from one wash cycle for use in a subsequent wash cycle.

U.S. Pat. No. 4,289,543 discloses a method for preconditioning a dishwashing machine wherein water introduced into the dishwashing machine tub, heated to an effective temperature, and sprayed throughout the tub to condition the food ware items for effective food removal and to pre-heat the tub. Washing and rinsing take place after the conditioning water is drained and fresh wash water is introduced.

U.S. Pat. No. 3,020,917 discloses a dishwasher wherein separate systems are provided for the rinse and wash cycles. The used wash water is retained for use in a subsequent wash cycle.

U.S. Pat. Nos. 4,872,466 and 4,810,306 disclose commercial dishwasher in which a portion of the wash water is drained between wash cycles. The commercial dishwashers described in the '466 and '306 patents have short wash cycles (i.e., three to four minutes) and use a single batch of water for washing and rinsing a rack of dishes. Fresh rinse water is combined with used wash water for subsequent racks of dishes.

SUMMARY OF THE INVENTION

In accordance with the present invention a method for operating a low energy domestic dishwashing machine is provided. The dishwashing machine includes a tub defining a sump which receives wash and rinse liquid. The dishwashing machine further includes a pump which is operable in a recirculation mode to distribute wash and rinse liquid throughout the tub via a wash arm and in a drain mode to deliver wash and rinse liquid to drain.

In further accordance with the present invention, the method comprises introducing a first quantity of wash liquid into the tub; operating the pump in the recirculation mode to wash soil from dishes contained in the tub; filtering soil from the wash liquid and storing the filtered soil in a filtration chamber; operating the pump in the drain mode to deliver a second predetermined quantity of wash liquid including entrained filtered soil to the drain; introducing into the tub an amount of fresh wash liquid generally equal to the second predetermined quantity of wash liquid; operating the pump in a recirculation mode to wash additional soil from the dishes; filtering the additional soil from the wash liquid and storing the additional filtered soil in the filtration chamber; and operating the pump in the drain mode to drain the wash liquid including the additional filtered soil from the tub.

In further accordance with the present invention, the wash liquid is heated following its introduction into the tub to a first predetermined temperature. The wash liquid is again heated following the introduction of the additional fresh wash liquid to return the wash liquid to the first predetermined temperature.

In further accordance with the present invention a series of rinse cycles occur following the wash cycles. Before the rinse cycles take place a short purge cycle occurs to flush any remaining soil in the sump to drain.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
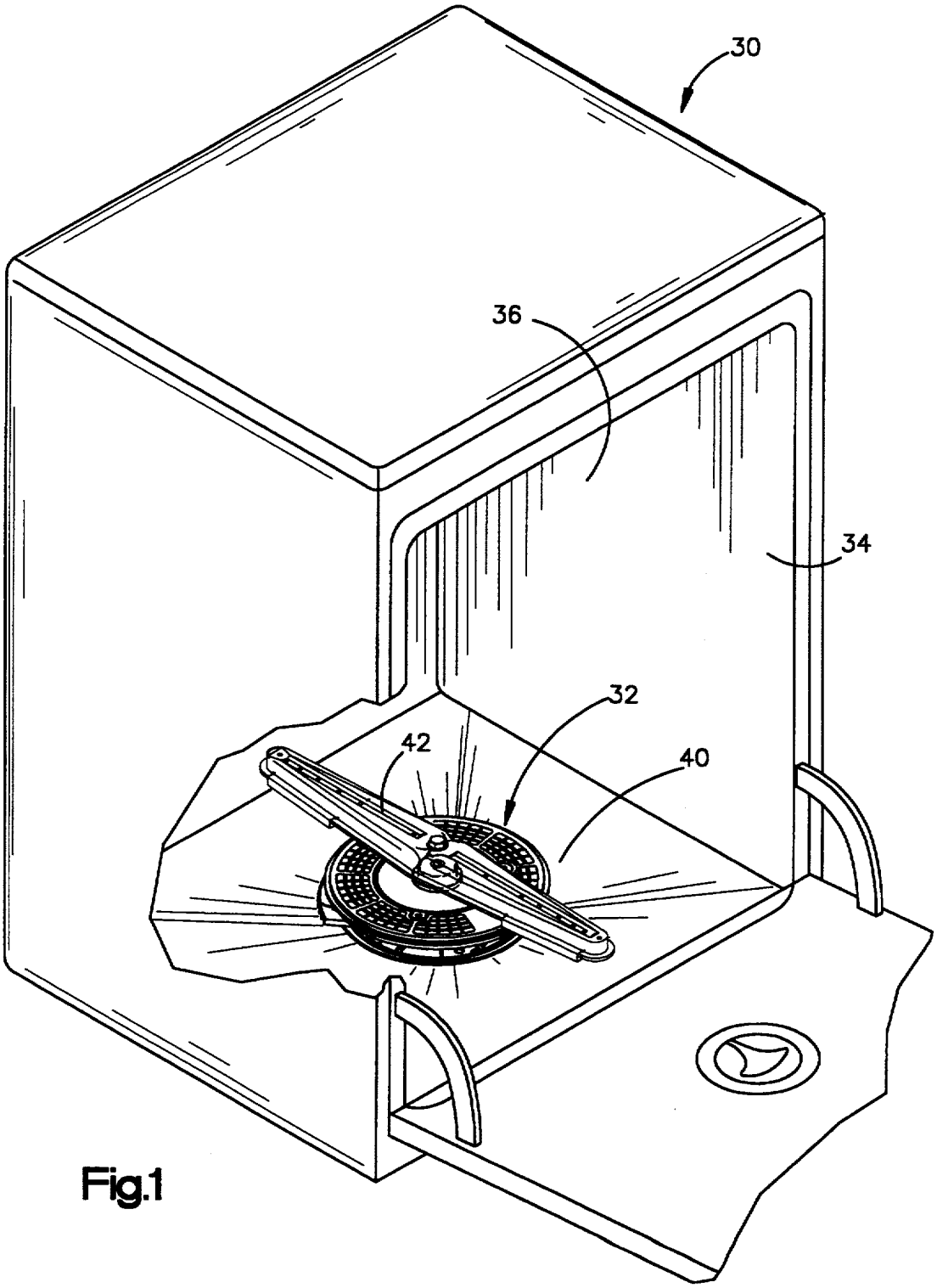
FIG. 1 shows a perspective view, with portions broken away, of a domestic dishwashing machine incorporating the present invention.

With reference to the drawing figures and, in particular, FIG. 1, a dishwashing machine 30 incorporating a wash and rinse liquid pump 32 is shown. As is conventional in the dishwashing machine art, the illustrated dishwashing machine 30 includes a tub 34 which defines a cavity or vat 36 for receipt of racks (not shown) upon which items to be washed are placed. The tub 34 has an open front that is closed by a door 38 hinged for pivotal movement about its bottom edge. A bottom of the tub defines a sump 40 which retains a quantity of wash or rinse liquid during a wash or recirculation mode and from which collected wash and rinse liquid is pumped during a drain mode.

The pump 32 extends upwardly through an opening in the bottom of the tub 34 and into the sump 40 defined thereby. A rotatably mounted wash arm 42 is secured to a top of the pump 32 and an upper, third level, or intermediate wash arm (not shown) is also preferably provided elsewhere in the tub cavity.

Figure 2:
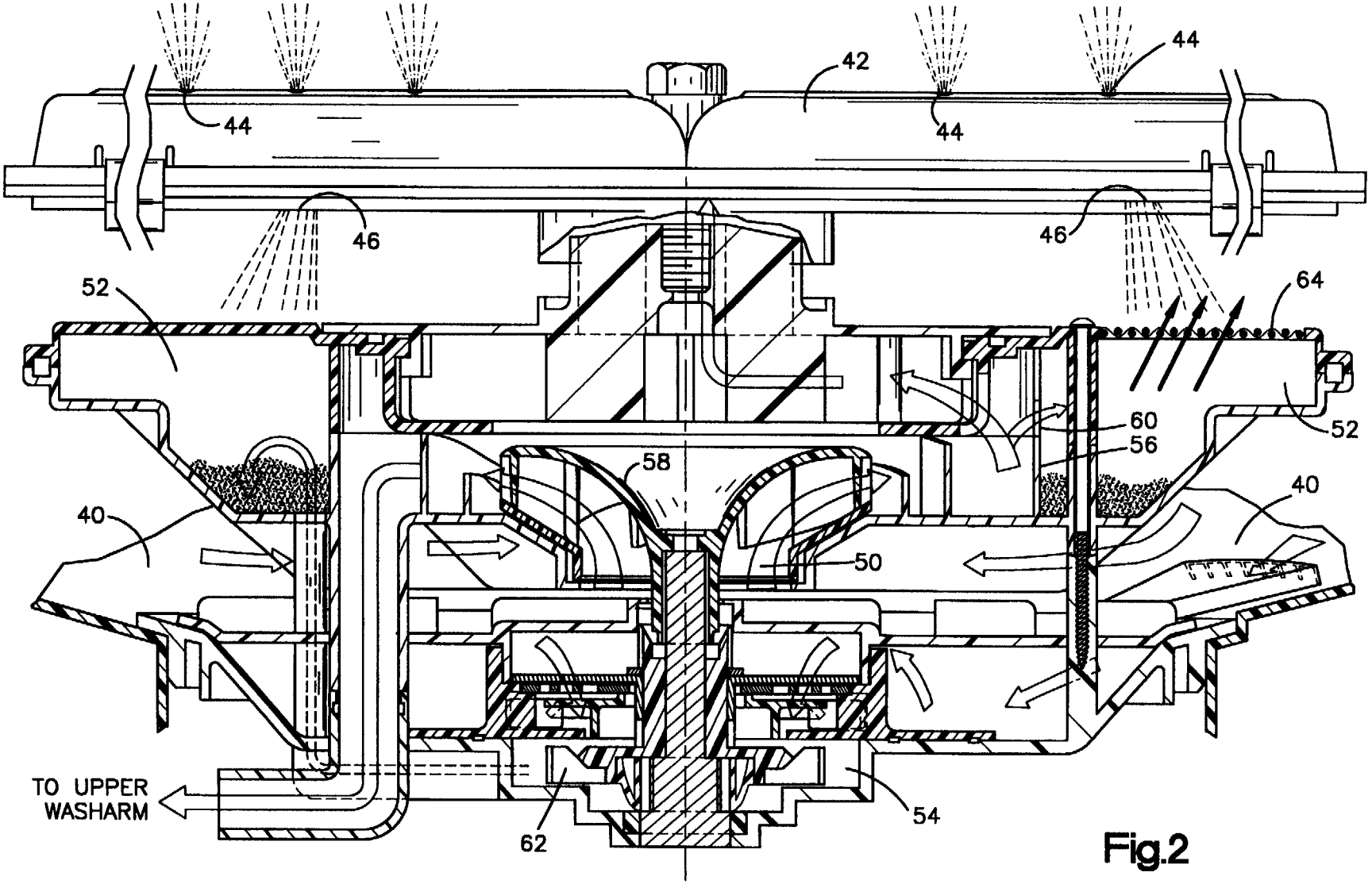
FIG. 2 is a front elevational view, partly in cross section, of a dishwasher pump and wash arm with the pump operated in a recirculation mode.

The wash arm 42 includes a number of upwardly and downwardly-directed openings or jets 44, 46 (FIG. 2). The upwardly-directed openings 44 supply a cleansing spray of wash liquid to the items within the tub 34. The downwardly-directed openings 46 preferably provide a filter cleansing and wash arm propelling spray of wash liquid. For a more detailed description of the preferred construction and operation of the wash arm, reference should be made to commonly-owned U.S. Pat. No. 5,333,631 is expressly incorporated herein in its entirety.

Naturally, any type of wash arm can be used with the pump 32 of the present invention without departing from the scope thereof.

Also, the pump 32 illustrated herein is more fully described in commonly-owned U.S. patent application Ser. No. 08/146,596, filed on Nov. 1, 1993, which is expressly incorporated herein in its entirety. It should be noted that the method of the present invention is capable of implementation with a variety of pumps and liquid distribution networks. Therefore, the pump 32 shown in the drawings and described hereafter is merely intended to illustrate a preferred embodiment of the present invention as currently contemplated by the inventors, and is in no way meant to limit the use or scope of the claimed method to the pump specifically disclosed herein.

The pump 32 includes a recirculation impeller chamber 50, a filtration chamber 52, and a drain impeller chamber 54. A cylindrical dividing wall 56 separates the filtration chamber 52 from the recirculation impeller chamber 50.

A recirculation impeller 58 is rotatably mounted in the recirculation impeller chamber 50 and is operable to draw wash or rinse liquid from the sump 40 and distribute same throughout the tub via the wash arm 42 when the pump 32 is operated in a recirculation mode. A portion of the liquid pumped by the recirculation impeller 58 is delivered to the filtration chamber 52 via a hole 60 in the dividing wall 56. The hole allows the recirculation impeller 52 to supplement the flow of liquid through the filtration chamber 52 supplied by a drain impeller 62, as will be described more fully hereafter. When the pump 32 is reversed to operate in a drain mode, air is introduced into the recirculation impeller chamber via a stand pipe (not shown), causing the recirculation impeller 58 to cavitate and be rendered generally inoperable.

The drain impeller 62 is rotatably mounted in the drain impeller chamber 54 and is operable to draw liquid from the sump 40 and deliver same to the filtration chamber 52 or to drain (not shown) depending upon the pump's mode of operation. When the pump is operated in the recirculation mode, the drain impeller 62 delivers liquid to the filtration chamber 52. The heavier soil in the liquid settles in the filtration chamber 52, while the less dense soil is filtered out of the liquid as it passes through filtration screens 64 provided at a top of the filtration chamber. The filtered liquid returns to the sump 40.

Figure 3:
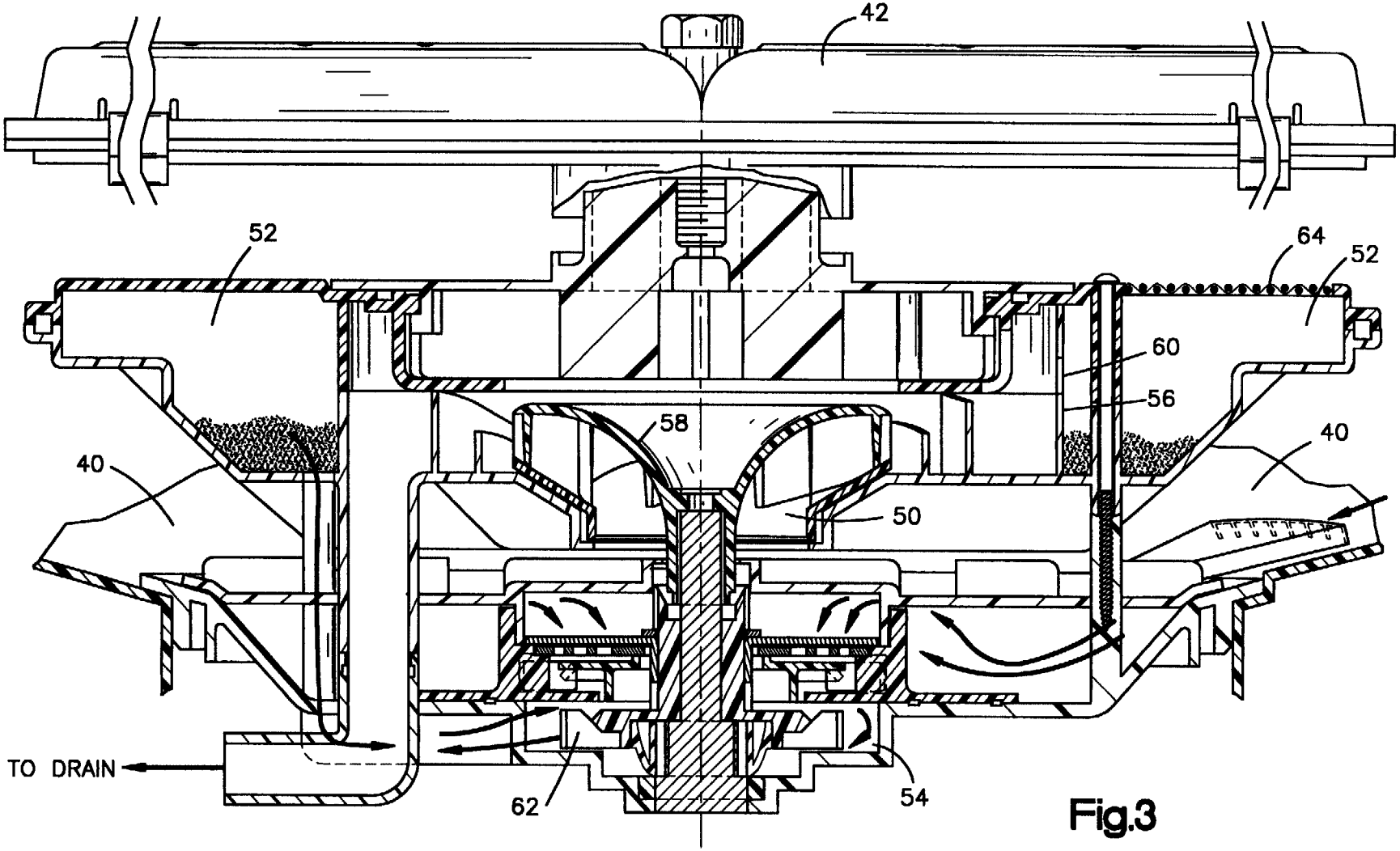
FIG. 3 is a front elevational view, partly in cross section, of the dishwasher pump and wash arm with the pump operated in a drain mode.
Figure 4:
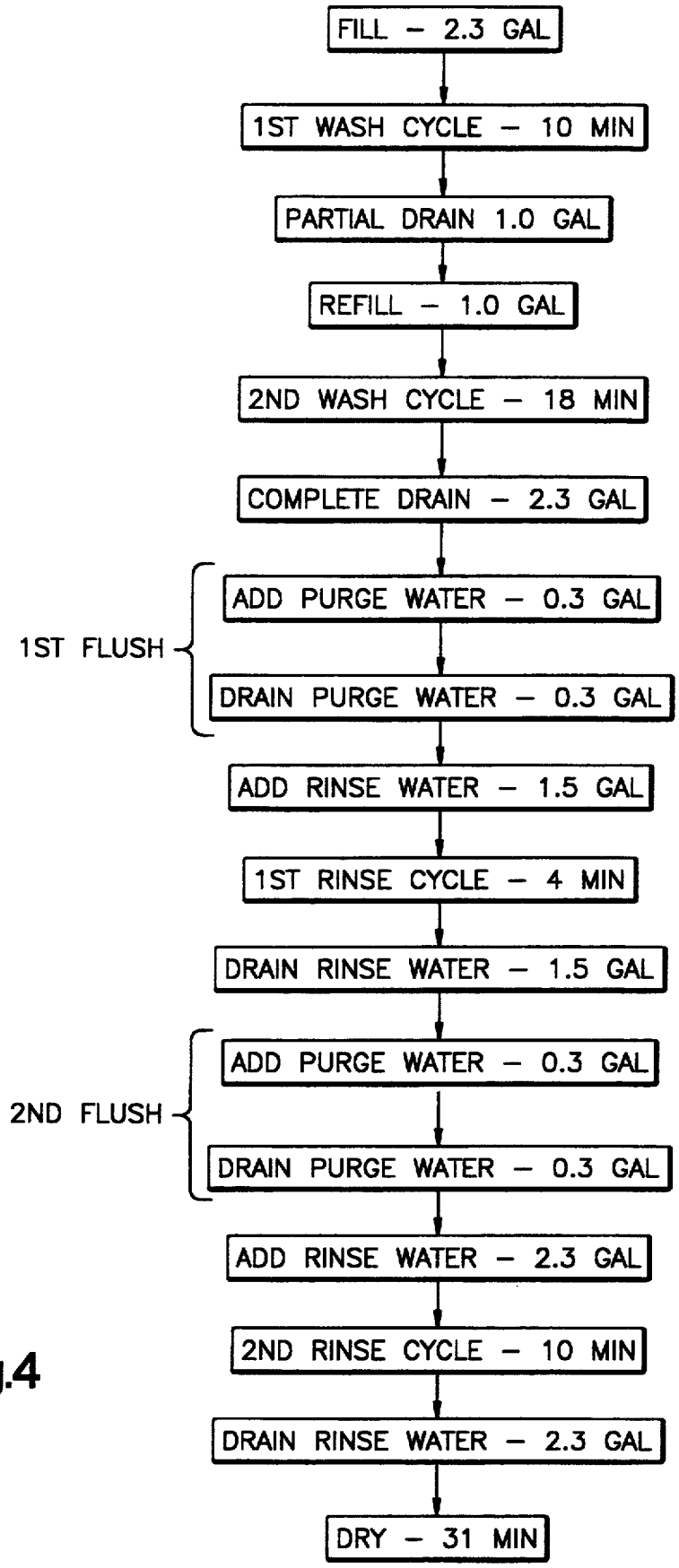
FIG. 4 is a flow chart showing the operation of a domestic dishwashing machine according to the method of the present invention.

When the pump 32 is operated in the drain mode, the liquid from the sump 40 and from the filtration chamber 52, including any associated soil, is pumped to drain (not shown) by the drain impeller 62 (FIG. 3).

The dishwasher pump described above is operated in the following manner. A quantity of soil laden dishes is loaded on racks (not shown) slidably mounted within the dishwasher tub 34. Although the following description will be of a "normal" wash cycle, other wash cycles (i.e., heavy soil cycle, pots and pans cycle) may be selected without departing from the scope of the present invention. Typically, these other cycles differ from a "normal" cycle in that more or longer wash cycles are employed and, thus, the inventive method described herein can also preferably be employed in these other cycles.

A predetermined volume or quantity of wash liquid is introduced into the dishwasher tub 34, i.e., about 2.3 gallons, and mixed with detergent. The wash liquid is heated to a first temperature and recirculated throughout the tub 34 during a first wash cycle. Preferably, the first temperature is about 140° F.

During the first wash cycle, the pump 32 is operated in the recirculation mode as illustrated in FIG. 2. As such, a majority of the wash liquid pumped by the recirculation impeller 58 is supplied to the wash arm 42, while a relatively smaller portion is supplied to the filtration chamber 52 via the hole 60. Another portion may be supplied to the upper wash arm (not shown). The liquid supplied to the wash arm 42 is sprayed throughout the tub 34, and washes soil from the dishes contained therein.

The drain impeller 62 pumps wash liquid from the bottom of the sump 40 into the filtration chamber 52. Filtered liquid exits the filtration chamber 52 via the filter screens 64 and returns to the sump, while filtered and settled soil is stored or retained within the filtration chamber 52. Hence, during the first wash cycle a substantial amount of the soil carried by the dishes is washed therefrom and stored in the filtration chamber 52.

At the end of the first wash cycle, which preferably lasts about 10 minutes, a partial drain cycle is performed. During this partial drain cycle wherein a predetermined quantity of liquid is pumped to drain, the wash liquid from the filtration chamber 52 together with a portion of the wash liquid in the sump 40 is pumped to drain by the drain impeller 62. Soil contained in the filtration chamber 52 or the bottom of the sump 40 will be carried with the liquid to drain.

Since a substantial amount of soil in the dishwasher was stored in the filtration chamber 52, draining the filtration chamber removes this soil from the dishwasher 30 and prevents the soil from being re-deposited on the dishes therein.

It has been found that since the soil is isolated and concentrated in the filtration chamber 52 only a partial drain cycle is necessary. Particularly, only approximately 1 gallon of the 2.3 gallons of wash liquid has to be drained to remove the soil from the filtration chamber 52. By limiting the amount of liquid drained during this cycle, the amount of fresh wash liquid that must be added is reduced without compromising the dish cleaning effectiveness of the dishwashing machine 30. Furthermore, limiting the amount of fresh wash liquid that must be added reduces the energy cost of re-heating the wash liquid to the first temperature.

Following the partial drain, the welsh liquid in the dishwasher 30 is relatively clean, and is supplemented by about 1 gallon of fresh wash liquid for the second wash cycle. The pump 32 is operated in the recirculation mode to further clean soil from the dishes and filter such additional soil from the wash liquid. The additional filtered soil is stored or retained in the filtration chamber 52. More detergent is introduced into the tub 34, and the wash liquid is re-heated to the first temperature. The second wash cycle, which preferably lasts about 18 minutes, is completed by operating the pump 32 in the drain mode to completely drain wash liquid and soil, including the additional filtered soil in the filtration chamber, from the sump 40 and filtration chamber 52.

Following the end of the second wash cycle, and before a first rinse cycle has begun, a short first flush cycle is performed. Preferably the flushing consists of introducing purging liquid into the sump 40 and then operating the pump 32 in the drain mode to drain the liquid and any remaining soil from the sump 40. Preferably, a small amount of liquid is used to flush or purge the sump, around 0.3 gallons.

Following the first flush cycle, the first rinse cycle takes place wherein about 1.5 gallons of fresh rinse liquid is introduced into the tub 34 and heated to a second predetermined temperature which may be higher, lower, or the same as the first predetermined temperature. The pump 32 is operated in the recirculation mode to filter soil from the rinse water and store the filtered soil in the filtration chamber 52. Following the first rinse cycle, which takes about 4 minutes, the pump 32 is operated in the drain mode to deliver rinse liquid and soil from the filtration chamber 52 and the sump 40 to drain.

Following the end of the first rinse .cycle, and before a first drain cycle is begun, a second flush cycle is performed. Preferably the second flush cycle is identical to the first flush cycle and, therefore, will not be further described herein.

Following the second flush cycle, the second rinse cycle takes place wherein about 2.3 gallons of fresh rinse liquid is introduced into the tub 34 and the pump 32 is operated in the recirculation mode. Soil is filtered from the rinse water and stored in the filtration chamber 52. Following the second rinse cycle, which takes about 10 minutes, the pump 32 is operated in the drain mode to deliver rinse liquid and soil from the filtration chamber 52 and the sump 40 to drain.

At the end of the second rinse cycle, the washing and rinsing of the dishes is complete, and a drying cycle begins wherein a heating element (not shown) in the sump 40 is cycled on and off, and a blower unit (not shown) is operated to dry the dishes. The operation of the heating .element and blower is conventional and will not be described more fully herein.

While the preferred embodiment of the present invention is shown and described herein, it is to be understood that the same is not so limited but shall cover and include any and all modifications thereof which fall within the purview of the invention.

What is claimed is:

1. A method for operating a low energy domestic dishwashing machine, said dishwashing machine comprising a pump and a dish-enclosing tub, said tub defining a sump for receipt of wash and rinse liquid and in which a heater is located, said pump being operable to take wash and rinse liquid from the sump and distribute same throughout the tub via a wash arm when operated in a recirculation mode and to deliver used wash and rinse liquid to drain when operated in a drain mode, said method comprising the steps of:

introducing a first quantity of wash liquid into the sump;

operating the pump in the recirculation mode during a first wash cycle to wash soil from dishes enclosed by the tub;

pumping said wash liquid into a filtration chamber, through a filter screen, and back into said sump;

filtering soil from said wash liquid as said wash liquid passes through said filter screen and storing said soil in said filtration chamber;

backflushing said filter screen to remove filtered soil therefrom and deposit said filtered soil in said filtration chamber;

operating the pump in the drain mode to deliver a second quantity of wash liquid including said filtered soil to said drain, said second quantity of wash liquid being less than said first quantity of wash liquid;

introducing into the sump an amount of fresh wash liquid at least equal to the second quantity of wash liquid drained therefrom;

operating the pump in the recirculation mode during a second wash cycle to wash additional soil from said dishes;

pumping said wash liquid into said filtration chamber, through said filter screen, and back into said sump;

filtering the additional soil from the wash liquid as said wash liquid passes through said filter screen and storing said additional filtered soil in the filtration chamber;

backflushing said filter screen to remove additional filtered soil therefrom and deposit said additional filtered soil in said filtration chamber;

operating the pump in the drain mode to drain said wash liquid including said additional filtered soil from said machine.

2. A method for operating a low energy domestic dishwashing machine as in claim 1, further comprising the step of:

flushing the sump after draining the additional filtered soil from the tub by injecting a first amount of purging liquid into the sump, and then draining said first amount of purging liquid from the sump, to rinse remaining soil from a bottom of the sump.

3. A method for operating a low energy domestic dishwashing machine as in claim 2, further comprising the steps of:

introducing a first quantity of rinse liquid into the sump following flushing thereof;

operating the pump in the recirculation mode to distribute the first quantity of rinse liquid throughout the tub;

pumping said rinse liquid into said filtration chamber, through said filter screen, and back into said sump;

filtering dirt from said rinse liquid as said rinse liquid passes through said filter screen and storing said filtered dirt in the filtration chamber;

backflushing said filter screen to remove said filtered dirt therefrom and deposit said filtered dirt in said filtration chamber;

operating the pump in the drain mode to drain said first quantity of rinse liquid including said filtered dirt from the machine.

4. A method for operating a low energy domestic dishwashing machine as in claim 3, further comprising the step of:

flushing the sump following draining of the rinse liquid therefrom by injecting a second amount of purging liquid into the sump, and then draining said second amount of purging liquid from the sump, to rinse additional remaining soil from a bottom of the sump.

5. A method for operating a low energy domestic dishwashing machine as in claim 4, further comprising the steps of:

introducing a second quantity of rinse liquid into the sump following flushing thereof with the second amount of purging liquid;

operating the pump in the recirculation mode to distribute the second quantity of rinse liquid throughout the tub;

pumping said rinse liquid into said filtration chamber, through said filter screen, and back into said sump;

filtering additional dirt from said second quantity of rinse liquid as said second quantity of rinse liquid passes through said filter screen and storing said filtered additional dirt in the filtration chamber;

backflushing said filter screen to remove said filtered additional dirt therefrom and deposit said filtered additional dirt in said filtration chamber;

operating the pump in the drain mode to drain said second quantity of rinse liquid including said filtered additional dirt from the machine.

6. A method for operating a low energy domestic dishwashing machine as in claim 1, wherein the heater is operated following introduction of said fresh wash liquid to return the wash liquid to a temperature.

7. A method for operating a low energy domestic dishwashing machine, said dishwashing machine comprising a wash liquid pump, a tub defining a sump for receipt of wash and rinse liquid and in which a heater is located, and means for admitting quantities of wash and rinse liquid into said tub, said pump being operable to distribute wash and rinse liquid throughout the tub via a wash arm during a recirculation mode and to deliver wash and rinse liquid to drain during a drain mode, said method comprising the steps of:

introducing a quantity of wash liquid into the tub;

heating the wash liquid with the heater to a first temperature;

operating the pump in a first recirculation mode;

pumping wash liquid into a filtration chamber, through a filter screen, and back into said tub, said filter screen being located above a static level of wash liquid in said tub;

filtering soil from said wash liquid as said wash liquid passes through said filter screen;

backflushing said filter screen to rinse said filtered soil from said filter screen;

retaining filtered soil in said filtration chamber;

operating the pump in the drain mode to deliver a second quantity of wash liquid from the tub and filtered soil from the filtration chamber to the drain, said second quantity of wash liquid being less than said first quantity of wash liquid;

refilling the tub with a volume of fresh wash liquid at least equal to the second quantity of wash liquid;

operating the pump in a second recirculation mode;

pumping wash liquid into said filtration chamber, through said filter screen, and back into said tub;

filtering additional soil from said wash liquid as said wash liquid passes through said filter screen;

backflushing said filter screen to rinse said additional filtered soil from said filter screen;

retaining the additional filtered soil in the filtration chamber; and, operating the pump in the drain mode to deliver the wash liquid from the tub and additional filtered soil from the filtration chamber to the drain.

8. A method for operating a low energy domestic dishwashing machine as in claim 7, wherein, following the step of refilling, the heater is operated to return the wash liquid to the first temperature.

9. A method for operating a low energy domestic dishwashing machine as in claim 8, comprising the further steps of:

flushing the sump by injecting a first amount of purging liquid into the sump, and then draining said first amount of purging liquid from the sump, to rinse remaining soil from a bottom of the sump;

introducing a first quantity of rinse liquid into the tub;

heating the rinse liquid to a second temperature;

operating the pump in the recirculation mode to distribute the rinse liquid throughout the tub;

filtering dirt from said rinse liquid as said rinse liquid passes through said filter screen and storing said filtered dirt in the filtration chamber;

operating the pump in the drain mode to drain said first quantity of rinse liquid including said filtered dirt from the machine.

10. A method for operating a low energy domestic dishwashing machine as in claim 9, further comprising the step of:

flushing the sump by injecting a second amount of purging liquid into the sump, and then draining said second amount of purging liquid from the sump, to rinse additional remaining soil from a bottom of the sump;

introducing a second quantity of rinse liquid into the tub;

heating said second quantity of rinse liquid to the second temperature;

operating the pump in the recirculation mode to distribute the second quantity of rinse liquid throughout the tub;

filtering additional dirt from said rinse liquid as said rinse liquid passes through said filter screen and storing said filtered additional dirt in the filtration chamber;

operating the pump in the drain mode to drain said second quantity of rinse liquid including said filtered additional dirt from the machine.

* * * * *

UNITED STATES PATENT AND TRADEMARK OFFICE

CERTIFICATE OF CORRECTION

PATENT NO. : 5,429,679

DATED : July 4, 1995

INVENTOR(S) : Young, Jr.

It is certified that error appears in the above-indentified patent and that said Letters Patent is hereby corrected as shown below:

On the title page, item [73] Assignee:
insert--White Consolidated Industries, Inc., Cleveland, Ohio--.

On the title page, before item [57], insert --Attorney, Agent, or Firm: Pearne, Gordon, McCoy & Granger--.

Column 5, line 16, delete "." (period).

Column 5, line 35, delete "." (period).

Signed and Sealed this

Seventh Day of November, 1995

Bruce Lehman

*Attest:*

BRUCE LEHMAN

*Attesting Officer*

*Commissioner of Patents and Trademarks*